US005562745A

United States Patent [19]

Gagliardi et al.

[11] Patent Number: 5,562,745

[45] Date of Patent: Oct. 8, 1996

[54] ABRASIVE ARTICLES, METHODS OF MAKING ABRASIVE ARTICLES, AND METHODS OF USING ABRASIVE ARTICLES

[75] Inventors: John J. Gagliardi; Jason A. Chesley, both of Hudson, Wis.; Charles H. Houck, Oakdale, Minn.; Walter L. Harmer, Arden Hills, Minn.; Gary L. Olson, Shoreview, Minn.

[73] Assignee: Minnesota Mining and Manufacturing Company, St. Paul, Minn.

[21] Appl. No.: 386,887

[22] Filed: Feb. 10, 1995

Related U.S. Application Data

[63] Continuation-in-part of Ser. No. 213,541, Mar. 16, 1994, abandoned.

[51] Int. Cl.[6] ..... B24D 3/24

[52] U.S. Cl. ..... 51/298; 51/295

[58] Field of Search ..... 51/298, 306, 307, 51/309

[56] References Cited

U.S. PATENT DOCUMENTS

| | | | |
|---|---|---|---|
| 2,272,873 | 2/1942 | Kistler | 51/298 |
| 2,408,319 | 9/1946 | Kistler | 51/307 |
| 2,421,623 | 6/1947 | Kistler | 51/295 |
| 2,811,430 | 10/1957 | Gregor et al. | 51/298 |
| 2,939,777 | 6/1960 | Gregor et al. | 51/298 |
| 2,940,841 | 6/1960 | Gregor et al. | 51/298 |
| 2,949,351 | 8/1960 | Vigliatura | 51/298 |
| 2,952,529 | 9/1960 | Stone | 51/298 |
| 3,246,970 | 4/1966 | Zimmerman | 51/298 |
| 3,256,076 | 6/1966 | Duwell et al. | 51/295 |
| 3,595,634 | 7/1971 | Sato | 51/298 |
| 3,676,092 | 7/1972 | Buell | 51/295 |
| 3,833,346 | 9/1974 | Wirth | 51/306 |
| 3,888,640 | 6/1975 | Bigorajski et al. | 51/298 |
| 3,926,585 | 12/1975 | Lukowski | 51/295 |
| 4,253,850 | 3/1981 | Rue et al. | 51/298 |
| 4,381,188 | 4/1983 | Waizer et al. | 51/298 |
| 4,475,926 | 10/1984 | Hickory | 51/298 |
| 4,609,381 | 9/1986 | Narayanan et al. | 51/298 |
| 4,877,420 | 10/1989 | Buxbaum et al. | 51/309 |
| 5,030,496 | 7/1991 | McGurran | 428/85 |
| 5,037,453 | 8/1991 | Narayanan et al. | 51/307 |
| 5,061,295 | 10/1991 | Hickory et al. | 51/298 |
| 5,110,321 | 5/1992 | Broberg et al. | 51/295 |
| 5,110,322 | 5/1992 | Narayanan et al. | 51/307 |
| 5,221,295 | 6/1993 | Zadar | 51/298 |
| 5,250,085 | 10/1993 | Mevissen | 51/298 |
| 5,269,821 | 12/1993 | Helmim et al. | 51/295 |
| 5,327,846 | 8/1943 | Kistler | 51/295 |
| 5,378,251 | 1/1995 | Culler et al. | 51/295 |

FOREIGN PATENT DOCUMENTS

| | | | |
|---|---|---|---|
| 029950A1 | 1/1989 | European Pat. Off. . | |
| 0418738 | 3/1991 | European Pat. Off. | B24D 3/28 |
| 0464850 | 1/1992 | European Pat. Off. | C09K 3/14 |
| 3112954 | 12/1981 | Germany . | |
| 2136011A | 9/1984 | United Kingdom | C08J 5/14 |
| WO92/05915 | 4/1992 | WIPO | B24D 11/00 |
| WO94/23898 | 10/1994 | WIPO | B24D 3/28 |

OTHER PUBLICATIONS

Abstract of JP 58,211,860 (English Abstract), Dec. 9, 1983.
Chemical Abstracts, vol. 100, No. 22, "Grinding Wheels With Improved Grinding Efficiency", May 28, 1984.
RU 2002601 (English Abstract), Nov. 15, 1993.

*Primary Examiner*—Deborah Jones
*Attorney, Agent, or Firm*—Gary L. Griswold; Walter N. Kirn; Doreen S. L. Gwin

[57] ABSTRACT

Abrasive articles comprising a plurality of abrasive particles, a combination of potassium tetrafluoroborate and a halogenated polymer, and a binder to which the plurality of abrasive particles are adhered, and methods of making and using the abrasive articles.

25 Claims, 2 Drawing Sheets

ABRASIVE ARTICLES, METHODS OF MAKING ABRASIVE ARTICLES, AND METHODS OF USING ABRASIVE ARTICLES

This application is a continuation-in-part application of U.S. Ser. No. 08/213,541, filed Mar. 16, 1994 now abandoned.

BACKGROUND OF THE INVENTION

1. Field of the Invention

This invention relates to abrasive articles, and in particular to abrasive articles comprising a combination of grinding aids. In particular, this invention relates to abrasive articles comprising a combination of potassium tetrafluoroborate and a halogenated polymer in a binder, as well as abrasive articles comprising a combination of potassium tetrafluoroborate in a halogenated polymer binder.

2. Discussion of the Art

Abrasive articles generally comprise abrasive grains secured within a binder. In a bonded abrasive, the binder bonds the abrasive grains together in a shaped mass. Typically, this shaped mass is in the form of a wheel and thus it is commonly referred to as a grinding wheel. In nonwoven abrasives, the binder bonds the abrasive grains to a lofty, open, fibrous substrate. In coated abrasives, the binder bonds the abrasive grains to a substrate or backing. Coated abrasives may include a first coated layer bonded to one side of the backing (commonly referred to as a make coating), at least one layer of abrasive grains bonded to the backing by the make coating, and a second coating layer overlaying the abrasive particles. The second coating layer commonly is referred to as a size coating; it reinforces the retention of the abrasive particles. Coated abrasives also may include an additional "supersize" coating overlaying the size coating. The supersize coating may include a grinding aid.

Abrasive binders typically consist of a glutinous or resinous adhesive, and, optionally, additional ingredients. Examples of resinous adhesives include phenolic resins, epoxy resins, urethane resins, acrylate resins and urea formaldehyde resins. Examples of typical additives include grinding aids, fillers, wetting agents, surfactants, pigments, coupling agents, and dyes.

The addition of grinding aids can significantly affect the chemical and physical processes of abrading metals to bring about improved performance. It is believed that grinding aids either (1) decrease the friction between the abrasive grains and the workpiece being abraded, (2) prevent the abrasive grains from "capping", i.e., prevent metal particles from becoming welded to the tops of the abrasive grains, (3) decrease the interface temperature between the abrasive grains and the workpiece, and/or (4) decrease the required grinding force. Capping can occur when the grinding of metal by abrasive articles produces freshly formed, hot, and uncontaminated metal surfaces. If the newly formed, uncontaminated metal surface is not rapidly "contaminated", metal can transfer and adhere to the abrasive particles ("capping"), which decreases grinding performance. Grinding aids may prevent capping by rapidly contaminating the freshly formed metal surface.

U.S. Pat. No. 5,030,496 (McGurran) pertains to flexible and resilient, nonwoven, surface treating articles formed of entangled synthetic fibers bonded together at points where they contact one another by a binder resin comprising plasticized vinyl resin and polymerized melamine-formaldehyde derivative.

U.S. Pat. No. 5,378,251 (Culler et al.) teaches a structured abrasive article having abrasive composites comprising a binder, abrasive grains, and a grinding aid.

U.S. Pat. No. 4,253,850 (Rue) teaches reduced volume of abrasive and increased volume of filler to enhance performance in snagging wheels and wheel segments for conditioning billets, slabs, and castings. The majority of the claimed fillers are halogenated inorganic salts or polymers wherein at least 80% by volume of the filler material is inorganic material.

U.S. Pat. No. 5,221,295 (Zador) teaches a grinding aid formulation comprising a water insoluble, halogenated hydrocarbon grinding aid. The grinding aid contains at least 50% by weight halogen (chlorine or bromine). The grinding aid is stable up to about 400° C., but decomposes below 600° C. The formulation also comprises a polymeric binder which results in the formulation being cured to a coherent film. The preferred grinding aids are chlorinated waxes including paraffin waxes.

WO94/23898 (Helmin) pertains to a coated abrasive size or supersize coating comprising a cured grinding aid binder which is a blend of a thermoplastic resin and a thermoset resin and an effective amount of a grinding aid dispersed in the cured grinding aid binder. The thermoplastic can be either a water based (emulsion) or a solvent based thermoplastic. The addition of thermoplastic improves the rheology of the grinding aid binder prior to coating and improves the overall performance of the resulting coated abrasive.

The abrasive industry is always evaluating means to improve the abrading efficiency of abrasive articles without unduly increasing their cost. It is also desired to provide a means for utilizing a high concentration of grinding aid in an abrasive product without significantly reducing the strength of the binder.

SUMMARY OF THE INVENTION

In one aspect, the invention features an abrasive article comprising a plurality of abrasive particles, a binder adhering said plurality of abrasive particles therein, and a combination of potassium tetrafluoroborate and a halogenated polymer.

One embodiment of this aspect of the invention includes an abrasive article comprising a plurality of abrasive particles in a binder and a peripheral coating comprising a combination of potassium tetrafluoroborate and a halogenated polymer. The abrasive particles and binder can be (1) adhered together in a shaped mass by the binder (thus defining a "bonded" abrasive); (2) adhered to a backing by the binder (thus defining a "coated" abrasive); or (3) adhered to the fibers of a lofty, open nonwoven web by the binder (thus defining a "nonwoven" abrasive). For example, the invention relates to a coated abrasive article comprising a backing having a major surface, a plurality of abrasive particles, a plurality of potassium tetrafluoroborate particles, a halogenated polymer, and a binder which bonds said abrasive particles, said plurality of potassium tetrafluoroborate particles, and said halogenated polymer to said major surface of said backing.

In one aspect of this embodiment, the peripheral coating can comprise potassium tetrafluoroborate and a halogenated polymer, the halogenated polymer acting as a binder. In another aspect, the peripheral coating can comprise potassium tetrafluoroborate, a plasticized halogenated polymer, and a thermosetting resin.

In another embodiment of this aspect of the invention, the invention relates to an abrasive article comprising (a) a plurality of abrasive particles and (b) a combination of potassium tetrafluoroborate and a halogenated polymer, (a) and (b) being adhered in a binder. The abrasive particles, binder, and grinding aid particles can be (1) adhered together in a shaped mass by the binder (thus defining a "bonded" abrasive); (2) adhered to a backing by the binder (thus defining a "coated" abrasive); or (3) adhered to the fibers of a lofty, open nonwoven web by the binder (thus defining a "nonwoven" abrasive).

In another aspect, this invention relates to an abrasive article comprising: (a) a plurality of abrasive particles; (b) a binder adhering the abrasive particles therein; and (c) a grinding composition consisting of a mixture of potassium tetrafluoroborate and a halogenated polymer, said potassium tetrafluoroborate and said halogenated polymer are present in an amount which provides improved abrasive performance of said abrasive article in at least one abrasive application over abrasive performance of an abrasive article of the same type with a grinding composition consisting only of potassium tetrafluoroborate or halogenated polymer alone.

Another aspect of the invention relates to an abrasive article comprising a plurality of abrasive particles and a plurality of erodible grinding aid agglomerates, each grinding aid agglomerate comprising potassium tetrafluoroborate particles and a halogenated polymer. The erodible grinding agglomerates can be adhered with the plurality of abrasive particles in or to a binder or, if small enough, i.e., having an average particle size of less than about 25 micrometers, can be adhered in or to a peripheral coating. In either embodiment, the abrasive particles and the binder and, if included, the erodible grinding aid agglomerates, can be (1) adhered together in a shaped mass by the binder to provide a bonded abrasive; (2) adhered to a backing by the binder to provide a coated abrasive; or (3) adhered to the fibers of a lofty, open nonwoven web by the binder to provide a nonwoven abrasive.

The invention relates to an erodible grinding aid agglomerate comprising a plurality of potassium tetrafluoroborate particles, a halogenated polymer, and a binder that adheres said potassium tetrafluoroborate and said halogenated polymer together. In addition, the erodible grinding aid agglomerate can comprise a plurality of potassium tetrafluoroborate particles and a halogenated polymer binder.

The invention also relates to a structured abrasive article comprising a backing having a major surface, a plurality of abrasive composites, each abrasive composite comprising a plurality of abrasive particles, a binder, and a combination of potassium tetrafluoroborate and a halogenated polymer.

The combination of potassium tetrafluoroborate and halogenated polymer gives rise to an improvement in cutting performance in most, if not all, applications. This combination does not necessarily show an improvement in cutting performance over an individual grinding aid alone in all applications but does show an improvement in at least one, application as described below.

DETAILED DESCRIPTION OF THE INVENTION

Figure 1:
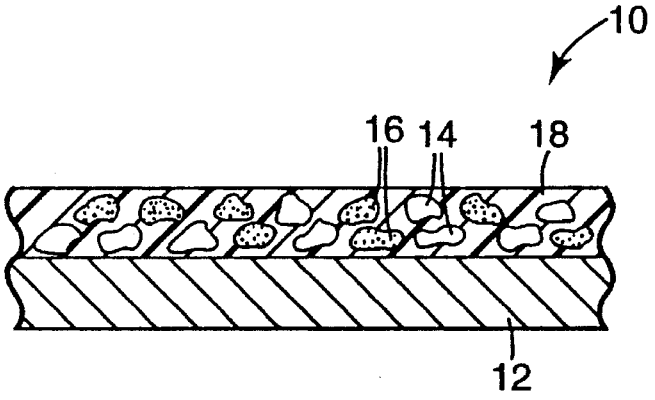
FIG. 1 is an enlarged cross-section of a coated abrasive in which erodible agglomerates and abrasive particles are dispersed throughout the binder.

As stated above, an abrasive article of this invention can be a bonded abrasive article, a nonwoven abrasive article, or a coated abrasive article as defined above. Since a preferred abrasive article is a coated abrasive article, reference is made herein to a description of a coated abrasive article. However, the description of abrasive particles and combination of potassium tetrafluoroborate and a halogenated polymer is applicable to all abrasive articles of this invention.

Coated abrasive articles commonly include a make coating and a size coating, and also can include a supersize coating; these constructions are known in the art. Each of these coatings include a binder. The term "binder", as used herein in the context of coated abrasive articles, refers to all of the binders used in the make, size, and (if present) supersize coatings. The phrase "abrasive particles", as used herein, includes both individual abrasive grains and agglomerates comprised of a plurality of abrasive grains. The term "dispersed", as used herein, does not necessarily denote a uniform dispersion.

BACKING

The backing in the coated abrasive has at least one major surface; the surfaces of a backing are typically referred to as a front and back surface but may be referred to as the above-mentioned "major surface" designating the surface to which the abrasive particles are bonded. The backing can be any conventional abrasive backing that is compatible with the binder. Examples include polymeric film, primed polymeric film, reinforced thermoplastic polymers, paper, vulcanized fiber, nonwovens, and combinations thereof. Other backings useful in this invention include those described in Assignee's European patent applications WO 9312911 and WO 9312912, both published Jul. 8, 1993. Both of these references describe thermoplastic backings having fibrous reinforcement therein. These applications are hereby incorporated by reference. The backing may also contain a treatment or treatments to seal the backing and/or modify some physical properties of the backing such as porosity. These treatments are known in the art.

The backing may also have an attachment means on its back surface to secure the resulting coated abrasive to a support pad or back-up pad. This attachment means can be a pressure sensitive adhesive or a loop fabric for a hook and loop attachment. Alternatively, there may be a intermeshing attachment system as described in the Assignee's U.S. Pat. No. 5,201,101, which is hereby incorporated herein by reference.

ABRASIVE PARTICLES

Abrasive particles useful in this invention may include single abrasive grains or single abrasive grains bonded together to form an abrasive agglomerate. Abrasive agglomerates are described, for example, in U.S. Pat. Nos. 4,311,489, 4,652,275, and 4,799,939, which are hereby incorporated by reference. Abrasive grains useful in this invention typically have a particle size ranging from about 0.1 to 1500 micrometers, usually between about 0.1 to 400 micrometers, preferably between 0.1 to 100 micrometers and most preferably between 0.1 to 50 micrometers. The preferred abrasive grains have a Mohs" hardness of at least about 8, more preferably above 9. Examples of suitable abrasive grains include fused aluminum oxide (which includes brown aluminum oxide, heat treated aluminum oxide, and white aluminum oxide), ceramic aluminum oxide, green silicon carbide, black silicon carbide, chromia, alumina zirconia, diamond, iron oxide, ceria, cubic boron nitride, boron carbide, garnet, and combinations thereof.

Abrasive agglomerates typically have an average diameter ranging from 20 to 3,000, preferably 100 to 1,000 micrometers.

The abrasive particles may include a surface coating that can have different functions. The surface coatings may increase adhesion to the binder, or alter the abrading characteristics of the abrasive particle. Examples of surface coatings include coupling agents, halide salts, metal oxides including silica, refractory metal nitrides, refractory metal carbides and the like.

STRUCTURED ABRASIVE ARTICLE/ABRASIVE COMPOSITES

Abrasive composites are shaped, preferably precisely shaped, and comprise a plurality of abrasive particles, a binder, and a combination of potassium tetrafluoroborate and a halogenated polymer.

The abrasive particles used in abrasive composites of this invention are as described above. Suitable binders include cured binder precursors which include acrylate monomer(s), acrylated epoxies, acrylated isocyanates, acrylated isocyanurates, acrylated urethanes, and combinations thereof.

The precisely shaped composites may have the following shapes: pyramids, truncated pyramids, cones, ridges, or truncated cones, preferably pyramids.

A preferred method for making a structured abrasive article comprising abrasive composites generally is described in Assignee's U.S. Pat. No. 5,152,917 (Pieper et al.) and in Assignee's U.S. Ser. No. 08/175,694 (Spurgeon et al.), both incorporated by reference.

One method for making a structured abrasive article of this invention involves introducing an abrasive slurry comprising a binder precursor, abrasive particles, and a combination of potassium tetrafluoroborate and a halogenated polymer onto a production tool, wherein the production tool has a specified pattern.

The binder precursor is then at least partially gelled or cured, before the intermediate article is removed from the outer surface of the production tool, to form a structured coated abrasive article, which is then removed from the production tool.

If the production tool is made from a transparent material, e.g., a polypropylene or polyethylene thermoplastic, then either visible or ultraviolet light can be transmitted through the production tool and into the abrasive slurry to cure the binder precursor. This step is further described in Assignee's U.S. Ser. No. 08/004,929 (Spurgeon).

Alternatively, if the backing is transparent to visible or ultraviolet light, visible or ultraviolet light can be transmitted through the backing to cure the binder precursor.

By at least partially curing or solidifying on the production tool, the abrasive composite has a precise shape and predetermined pattern. However, the production tool can be removed before a precise shape has been achieved resulting in an abrasive composite that does not have a precise shape. The binder precursor can be further solidified or cured off the production tool.

The phrase "production tool" as used herein means an article containing cavities or openings therein. For example, the production tool may be a cylinder, a flexible web, or an endless belt. A backing is introduced onto the outer surface of the production tool after the cavities have been filled so that the abrasive slurry contained in the cavities wets one major surface of the backing to form an intermediate article. The binder precursor is then at least partially cured or gelled, before removing the intermediate article from the outer surface of the production tool. Alternatively, the abrasive slurry can be introduced onto the backing so that the abrasive slurry wets one major surface of the backing to form an intermediate article. The intermediate article is then introduced to a production tool having a specified pattern.

The production tool can be a belt, a sheet, a continuous sheet or web, a coating roll, a sleeve mounted on a coating roll or die. The outer surface of the production tool can be smooth or have a surface topography or pattern. The pattern will generally consist of a plurality of cavities or features. The resulting abrasive particle will have the inverse of the pattern from the production tool. These cavities can have any geometric shape such as a rectangle, semicircle, circle, triangle, square, hexagon, pyramid, octagon, etc. The cavities can be present in a dot-like pattern or continuous rows, or the cavities can butt up against one another.

The production tool can be made from metal or be made from a thermoplastic material. The metal tool can be fabricated by any conventional technique such as engraving, hobbing, electroforming, diamond turning and the like.

The following description outlines a general procedure for making a thermoplastic production tool. A master tool is first provided. If a pattern is desired in the production tool, then the master tool should also have the inverse or the pattern for the production tool. The master tool is preferably made out of metal, e.g., nickel. The metal master tool can be fabricated by any conventional technique such as engraving, hobbing, electroforming, diamond turning, etc. The thermoplastic material is then heated optionally along with the master tool so that the thermoplastic material is embossed with the master tool pattern. After the embossing, the thermoplastic material is cooled to solidify.

A peripheral coating comprising a combination of potassium tetrafluoroborate and a halogenated polymer can be at least partially coated over the abrasive composites. For example, if the abrasive composite is in the shape of a truncated pyramid, the peripheral coating could be coated on the tops of the truncated pyramid.

COMBINATION OF POTASSIUM TETRAFLUOROBORATE AND HALOGENATED POLYMERS

Potassium tetrafluoroborate is typically in the form of particles which preferably have an average particle size of between 1 micrometer and 150 micrometers. More preferred potassium tetrafluoroborate particles have an average particle size of between 5 micrometers and 100 micrometers, most preferably between 5 micrometers and 50 micrometers.

Examples of halogenated polymers useful in this invention include polyvinyl halides (e.g. polyvinyl chloride) and polyvinylidene halides such as disclosed in U.S. Pat. No.

3,616,580; highly chlorinated paraffin waxes such as those disclosed in U.S. Pat. No. 3,676,092; completely chlorinated hydrocarbon resins such as those disclosed in U.S. Pat. No. 3,784,365; and fluorocarbons such as polytetrafluoroethylene and polytrifluorochloroethylene as disclosed in U.S. Pat. No. 3,869,834. The more preferred halogenated polymers are polyvinyl chloride and polyvinylidene chloride.

Preferred halogenated polymers are solids having an average particle size of between 1 micrometers and 150 micrometers, and more preferably between 10 micrometers and 100 micrometers. The polymer particles can be round, or can be another selected shape. The halogenated polymer, when acting as a binder, is in latex form or is plasticized.

The quantity of potassium tetrafluoroborate and halogenated polymer used in the abrasive article should be sufficient to provide the desired grinding aid affect and/or achieve improved abrasive performance in at least one abrasive application over an abrasive article containing potassium tetrafluoroborate or halogenated polymer alone. Preferably, the weight ratio of potassium tetrafluoroborate to halogenated polymer is such that the combination provides a synergistic effect in comparison to using only the potassium tetrafluoroborate or the halogenated polymer alone in the same quantity as the total amount of the combination. Preferred abrasive articles include potassium tetrafluoroborate and halogenated polymer in a ratio of between 10:90 and 90:10 by weight, more preferably in a ratio of between 30:70 and 70:30 by weight. A particularly preferred ratio of potassium tetrafluoroborate to halogenated polymer is 60:40 by weight.

The combination of potassium tetrafluoroborate and a halogenated polymer may be present in the abrasive article: (a) dispersed with a plurality of abrasive particles in a binder, (b) as a plurality of erodible grinding aid agglomerates dispersed with a plurality of abrasive particles in a binder, (c) dispersed in a peripheral coating, (d) as a plurality of erodible grinding aid agglomerates dispersed in a peripheral coating, (e) as a plurality of potassium tetrafluoroborate particles in a halogenated polymeric binder, (f) as a plurality of potassium tetrafluoroborate particles in a binder consisting of a blend of a plasticized, halogenated polymer and a thermoset resin, and (g) combinations thereof. In coated abrasive articles, the phrase "peripheral coating" refers to an outermost coating on the abrasive surface of the article and typically is the size or supersize coating. The peripheral coating preferably includes a binder, which may be a polyvinylchloride latex or a plasticized polyvinylchloride. To enhance adhesion and performance, a binder can be added to the plasticized polyvinylchloride.

COMBINATION OF GRINDING AIDS DIRECTLY IN A BINDER

As mentioned above, the combination of potassium tetrafluoroborate and halogenated polymer can be dispersed with abrasive particles in a binder or in a peripheral coating, e.g., a size coating or a supersize coating. The peripheral coating preferably includes between 1 percent and 90 percent, more preferably between 20 percent and 70 percent, of the grinding aid combination by weight; and between 10 percent and 40 percent, more preferably between 25 percent and 35 percent, of the binder by weight. The peripheral coating may contain non-abrasive additives that affect its erodability, e.g., glass bubbles.

Particularly preferred abrasive articles include a peripheral coating comprising potassium tetrafluoroborate and polyvinyl chloride, which acts not only as a grinding aid but also as a binder. In addition, a preferred abrasive article includes a peripheral coating comprising potassium tetrafluoroborate, plasticized polyvinylchloride, and a thermosetting binder. Useful thermosetting binders include epoxy binders, phenolic binders, melamine formaldehyde binders, acrylate binders, and latex binders. Plasticized materials, or "plastisols" are stable, pourable, cream-like dispersions of resin powders, e.g., polyvinyl chloride in a plasticizer. Paste systems of polyvinyl chloride resins are formulated so that the plasticizer wets the resin particle at room temperature but only very slowly penetrates and solvates the resin. Upon heating, the paste systems fuse to provide a well plasticized resin. Plasticizers suitable for polyvinyl chloride generally are low viscosity, organic esters, for example, dioctyl phthalate, di-2-ethylhexyl phthalate, diisononyl phthalate, and triphenyl or diphenyl alkyl phosphate, and generally are 100% solids systems. These systems generally do not require an organic solvent and the total cure or fusion time is very short since no volatile solvents have to be removed prior to curing or fusion.

COMBINATION OF GRINDING AIDS AS AN ERODIBLE AGGLOMERATE

The term "erodible", as used herein, means that the grinding aid agglomerate of the invention has the ability to break down in a controlled manner, for example, by fracture, mechanical stress, and/or by dissolving fully or in part under wet grinding conditions. "Wet" means grinding conditions where a water spray or flood is used.

FIGS. 1–5 illustrate in cross-section coated abrasive articles in which the potassium tetrafluoroborate particles and halogenated polymer particles are incorporated into a binder in the form of erodible agglomerates.

Binders suitable to adhere the potassium tetrafluoroborate and the halogenated polymer together include cured conventional inorganic or organic binder precursors. Examples of inorganic binder precursors include metal, clay, glass, and the like. Examples of organic binder precursors include both thermoplastic and thermosetting binder precursors. Examples of thermosetting binder precursors include phenolic, urea formaldehyde, melamine formaldehyde, epoxy, acrylate, aminoplast, urethane, and the like. Examples of thermoplastic binder precursors include polystyrene, nylon, and polyester. The erodible agglomerates preferably include between 1 percent and 50 percent, more preferably between 2 percent and 30 percent, of binder by weight. The remainder is the grinding aid combination and optional additives.

A useful class of binders for the erodible grinding aid agglomerates include lignosulfonate binders. Typically, lignosulfonates are produced from the waste liquor from the sulfate pulping process of wood in the paper industry. The term "lignosulfonate", as used herein, means the sulfonate salt of lignin. Lignin is the generic name for the amorphous, highly polymerized product which forms the middle lamella of many plant fibers (especially woods) and contains at least four condensed molecules of coniferol. Although the exact molecular structure of lignosulfonate is unknown, the molecular weight of lignosulfonates cover a broad range. For example, some lignosulfonates have weight average molecular weights below 1,000, while other lignosulfonates have weight average molecular weights greater than 1,000,000. The basic building unit of lignosulfonates is believed to be a phenyl propane. Examples of lignosulfonate binders include sodium lignosulfonate and calcium lignosulfonate.

The erodible grinding aid agglomerates can be prepared by thoroughly mixing potassium tetrafluoroborate, halogenated polymer, and a binder precursor. These materials may be mixed together by any conventional technique such as milling, low shear mixing, high shear mixing, and the like. Any processing aids, optional additives, water, or an organic solvent may optionally be added into this mixture. The mixture is then heated for purposes of drying, curing the binder precursor in the process. The resulting dried mixture is crushed and screened to the appropriate particle size distribution. Alternatively, the mixture can be shaped either by extrusion or molding to form a shaped erodible agglomerate, as known in the art such as described in WO 95/01241 (Holmes et al. ), which is hereby incorporated by reference. The shape can be a rod, a pyramid, a cone, sphere, a cube and the like. Before, during, or after shaping any unwanted volatile materials can be removed by drying.

The erodible grinding aid agglomerates may also be prepared by passing the thoroughly mixed combination of grinding aid particles and binder precursor through a pan agglomerator, pin agglomerator, a briquetter, an extruder, a roller press, a flat die press, a pellet mill, or the like. Subsequently, heat may be applied for further drying.

The ratio of the average size of the abrasive particles to the average size of the erodible agglomerates can range from about 1:2.5 to about 1:0.5. It is preferred that the abrasive particles be about the same average size as the erodible agglomerates. The volume of an average erodible agglomerate to the volume of an average abrasive particle preferably ranges from 0.08:1 to 1.75:1, and more preferably ranges from 0.5:1 to 1:1.

These erodible agglomerates can be dispersed with the plurality of abrasive particles in a binder or, if small enough, i.e., having an average particle size of less than about 25 micrometers, be dispersed in a peripheral coating.

BINDER SYSTEM

The binder precursor which is cured to form the binder used in the coated abrasive article can be any of the conventional resinous or glutinous adhesives used in coated abrasives. Examples of resinous adhesives include phenolic resins, urea formaldehyde resins, urethane resins, acrylate resins, aminoplast resins, epoxy resins, latices, and combinations thereof.

The binder serves to adhere the abrasive particles and other components such as potassium tetrafluoroborate particles and halogenated polymer therein. The term "adhered" or phrase referring to "adhered therein" as used throughout means that the abrasive particles or other components are completely within the binder or at least partially within the binder or attached to the binder.

OPTIONAL ADDITIVES

The binder precursor and erodible agglomerates of the invention can include optional additives such as fillers, fibers, lubricants, wetting agents, thixotropic agents, surfactants, pigments, dyes, antistatic agents, coupling agents, plasticizers, and suspending agents. The amounts of these materials are selected to provide the properties desired. The use of additives can, for example, affect the erodability of the erodible agglomerates. The erodible agglomerates of the invention and/or the binder also can include other conventional grinding aids in addition to potassium tetrafluoroborate and the halogenated polymer. For example, a thermoplastic additive can be added to a thermosetting binder utilized with grinding aid filler to improve rheology of the filled formulation and improve overall performance of the resulting abrasive as described in WO 94/23898.

COATED ABRASIVE ARTICLES

Referring to FIG. 1, illustrated in cross-section is coated abrasive 10, which includes backing 12, abrasive particles 14, erodible agglomerates 16, and abrasive binder 18. Coated abrasive 10 is prepared by (1) thoroughly mixing abrasive particles 14, erodible grinding aid agglomerates 16, and an abrasive binder precursor; (2) coating the mixture onto backing 12; and (3) exposing the binder precursor to conditions sufficient to cure or solidify the binder precursor. Preferred exposure conditions include heat and/or radiation energy, or a combination thereof, as is known in the art.

Figure 2:
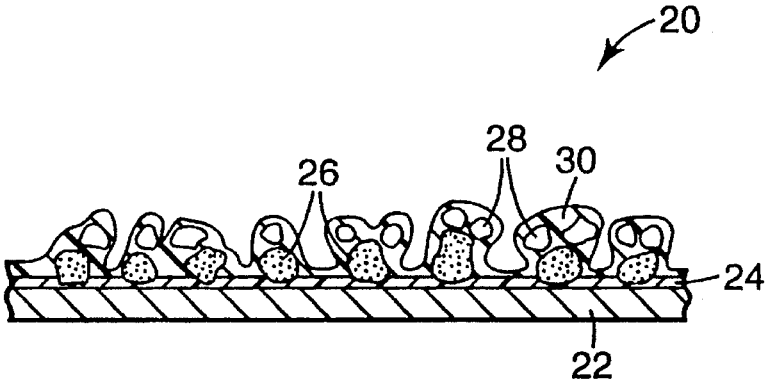
FIG. 2 is an enlarged cross-section of a coated abrasive in which abrasive particles are located substantially over erodible agglomerates.

Referring to FIG. 2, illustrated in cross-section is coated abrasive 20, which includes backing 22, make coating 24, erodible grinding aid agglomerates 26, abrasive particles 28 located substantially over the erodible agglomerates, and size coating 30 covering the abrasive particles. The make and size coatings can comprise the same material or different materials. Coated abrasive 20 in FIG. 2 is prepared by: (1) applying a make coating precursor to the backing; (2) coating erodible agglomerates 26 onto the make coating precursor; (3) coating abrasive particles 28 over the erodible agglomerates; (4) optionally exposing the make coating precursor to conditions sufficient to partially cure or solidify the make coating precursor; (5) applying a size coating precursor 30; and (6) exposing the make and size coating precursors to conditions sufficient to fully cure or solidify the precursors.

Figure 3:
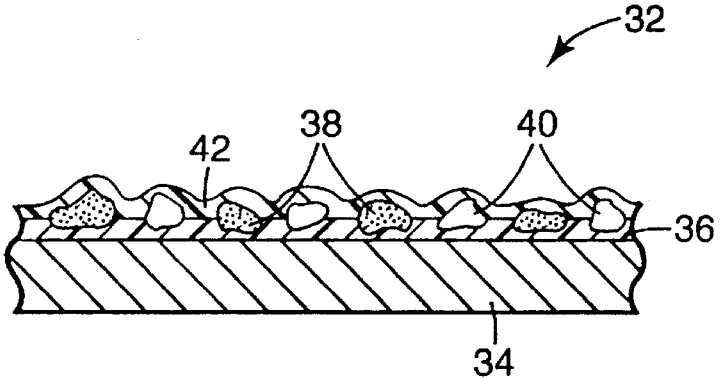
FIG. 3 is an enlarged cross-section of a coated abrasive in which abrasive particles are located substantially in-between erodible agglomerates.

Referring to FIG. 3, illustrated in cross-section is coated abrasive 32, which includes a backing 34, make coating 36, erodible grinding aid agglomerates 38, abrasive particles 40, and size coating 42. In this embodiment, the abrasive particles are located substantially only in-between the erodible agglomerates. Coated abrasive 32 is prepared by the same general procedure as is used to prepare coated abrasive 20, except that erodible agglomerates 38 and abrasive particles 40 are coated as a mixture onto the make coating precursor.

Figure 4:
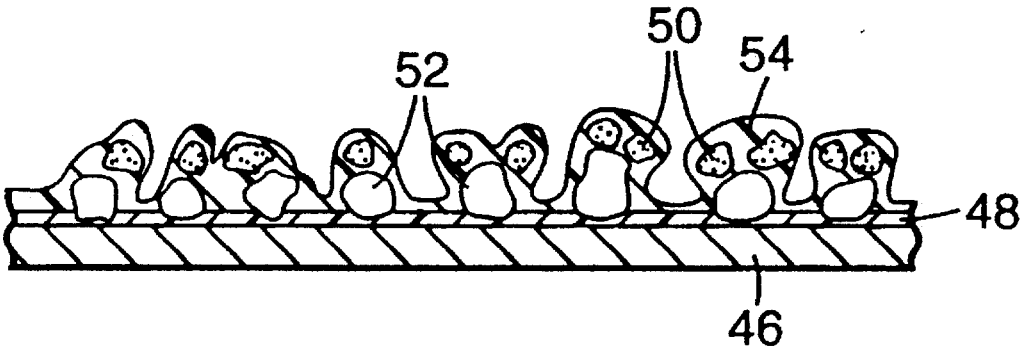
FIGS. 4 and 5 are enlarged cross-sections of coated abrasives in which abrasive particles are located substantially underneath erodible agglomerates.

Referring to FIG. 4, illustrated in cross-section is coated abrasive 44, which includes backing 46, make coating 48, erodible grinding aid agglomerates 50, abrasive particles 52, and size coating 54. In this embodiment, the abrasive particles are located substantially underneath the erodible agglomerates. Coated abrasive 44 is prepared by the same general procedures as are used to prepare coated abrasive 20, except that abrasive particles 52 are coated onto the make coating precursor before erodible agglomerates 50 are coated.

Figure 5:
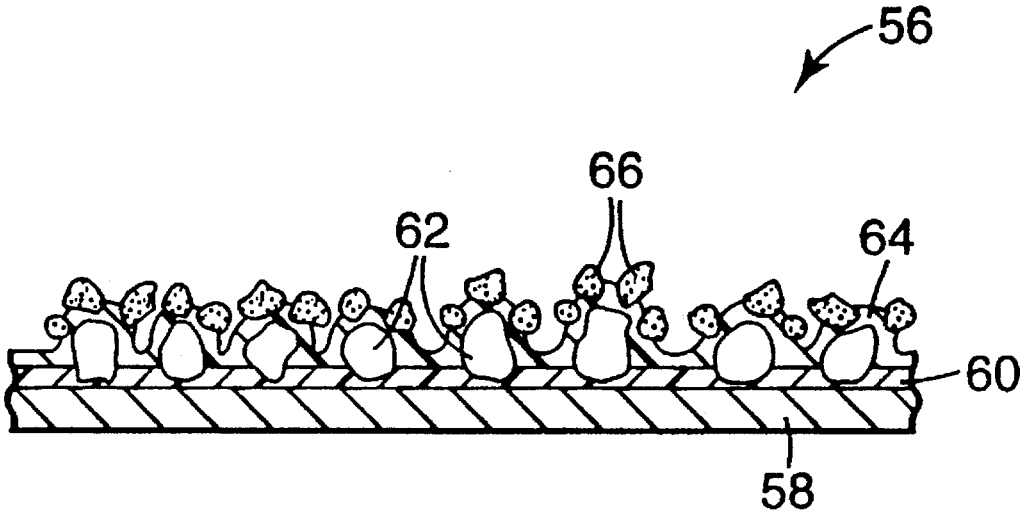

Referring to FIG. 5, illustrated in cross-section is coated abrasive 56, which includes backing 58, make coating 60, abrasive particles 62, size coating 64 overlaying the abrasive particles, and erodible grinding aid agglomerates 66 adhered to the size coating. Coated abrasive 56 is prepared by: (1) applying a make coating precursor to backing 58; (2) coating abrasive particles 62 onto the make coating precursor; (3) optionally partially curing or solidifying the make coating precursor; (4) applying a size coating precursor over the abrasive grains; (5) coating erodible agglomerates 66 onto the size coating precursor; and (6) fully curing or solidifying the binder precursors.

The coated abrasives illustrated in FIGS. 2–5 include make and size coatings. Alternative preferred coated abrasives may include a supersize coating containing a combination of grinding aids, wherein the make and size coatings are devoid of the grinding aid combination.

As described above, the combination of potassium tetrafluoroborate and halogenated polymer (or erodible agglomerates containing this combination) also can be incorporated into an abrasive composite as described, for example, in U.S. Pat. No. 5,152,917, and Assignee's U.S. patent application Ser. No. 08/121,110, filed Sep. 13, 1993, both of which are hereby incorporated by reference. These abrasive composites can be in an array attached to a backing. Coated abrasives that include a random array of abrasive composites attached to a backing are described in assignee's U.S. patent application Ser. No. 08/120,300 (Hoopman et al. ), which is hereby incorporated by reference.

METHOD OF MAKING A COATED ABRASIVE ARTICLE

Coated abrasive articles of this invention can be made by, for example, (1) applying a make coating precursor to the backing; (2) drop coating or electrostatically coating the abrasive particles into the precursor; (3) partially curing the make coating precursor; (4) applying a size coating precursor including a combination of potassium tetrafluoroborate particles and halogenated polymer particles or a plurality of erodible grinding aid agglomerates including the combination; and (5) fully curing the make and size coating precursors. Alternatively, a coating including the grinding aid combination and a supersize coating precursor can be applied over the size coating (which may or may not also include the combination of grinding aids) using conventional methods. The make coating, size coating, or supersize coating binders typically are thermosetting binders including phenolic resins, epoxy resins, and the like. In addition, the combination of grinding aids, including a combination in the form of a plurality of erodible grinding aid agglomerates, can be applied just before, during, or just after coating the abrasive particles by drop coating or electrostatic application.

METHOD OF MAKING OTHER ABRASIVE ARTICLES

The abrasive particles and the combination of potassium tetrafluoroborate particles and halogenated polymer particles, or erodible agglomerates including this combination, can be incorporated into bonded abrasive articles. The combination of potassium tetrafluoroborate and halogenated polymer and/or erodible agglomerates containing this combination, along with the abrasive particles, may be dispersed throughout the binder used to form the bonded abrasive articles. Alternatively, the combination and/or erodible agglomerates containing the combination may be dispersed in a binder precursor and applied as a peripheral surface coating on a bonded abrasive, or to voids within the bonded abrasive; the binder precursor can then be cured or solidified by known methods. The bonded abrasive can be a conventional flexible bonded abrasive employing an elastomeric polyurethane as the binder matrix. The polyurethane binder matrix may be a foam as disclosed in U.S. Pat. Nos. 4,613,345, 4,459,779, 2,972,527, 3,850,589; UK Patent Specification No. 1,245,373 (published Sep. 8, 1971); or the polyurethane binder may be a solid, as disclosed in U.S. Pat. Nos. 3,982,359, 4,049,396, 4,221,572, 4,933,373, and 5,250,085. All of these patents are hereby incorporated herein.

A general procedure for making a bonded abrasive incorporating the grinding aid agglomerates of the invention includes mixing together binder precursor, abrasive particles, the combination of potassium tetrafluoroborate and halogenated polymer (and/or erodible grinding aid agglomerates including the combination), and optional additives to form a homogenous mixture. This mixture is then molded to the desired shape and dimensions. The binder precursor is then cured and solidified to form the bonded abrasive.

The combination of potassium tetrafluoroborate and halogenated polymer and/or erodible agglomerates including the combination also can be incorporated into lofty, open nonwoven abrasives, which are generally illustrated in U.S. Pat. No. 2,958,593, and those prepared according to the teachings of U.S. Pat. No. 4,991,362 and U.S. Pat. No. 5,025,596, all of which are hereby incorporated by reference. In general, nonwoven abrasives included open, lofty, three-dimensional webs of organic fibers bonded together at points where they contact by an abrasive binder. These webs may be roll coated, spray coated, or coated by other means with binder precursors compositions including the grinding aid particles and/or erodible agglomerates and subsequently subjected to conditions sufficient to cure or solidify the resin.

A general procedure for making a nonwoven abrasive incorporating the combination of potassium tetrafluoroborate and halogenated polymer includes mixing together binder precursor, abrasive particles, combination of potassium tetrafluoroborate and halogenated polymer (and/or erodible grinding aid agglomerates including the combination ), and optional additives to form a homogeneous mixture. This mixture is then sprayed or coated into a fibrous, lofty, nonwoven substrate. The binder precursor is then cured and solidified to form the nonwoven abrasive.

METHOD OF USING A COATED ABRASIVE ARTICLE

The coated abrasive articles of the invention can be used for abrading metals, including stainless steel and titanium. As used herein the term "abrading" is used generally to include grinding, polishing, finishing, and the like.

The method of abrading metal workpieces includes contacting the workpiece with a peripheral surface of an abrasive article, with sufficient force (typically more than about 1 kg/cm$^2$) to abrade the metal workpiece while the peripheral surface and workpiece are moving in relation to each other. Either the workpiece or the abrasive article may be stationary.

A general reference for grinding of metals is Chapter 7 of the book entitled "Coated Abrasives - Modern Tool of Industry", pp. 150–200, published by the Coated Abrasives Manufacturers' Institute in 1958. As stated therein, for each application there is an optimum combination of a particular kind of coated abrasive used in a specific grade sequence and the right type of equipment which will give the best results in terms of production, finish, and cost. Factors to be considered are the metallurgy of the workpiece, the shape, size, and condition of the workpiece, the power of the equipment to be used, type of contact wheel used, and the desired finish.

The coated abrasive can be shaped in the form of a belt, disc, sheet, or the like. In embodiments in which the abrasive article is a continuous abrasive belt, the choice of contact wheel, force employed, and abrasive belt speed depends on the desired rate of cut and the resulting surface finish on the workpiece, care being taken not to damage the workpiece.

The contact wheel may be plain or serrated. The force between the abrasive article and the workpiece may range from 0.02 kg/cm to 60 kg/cm, typically and preferably from about 0.04 kg/cm to about 40 kg/cm. The belt speed may range from 305 meters per minute (mpm) to 3,050 mpm, more typically and preferably from about 915 mpm to about 2,135 mpm.

The following examples and test procedures will further illustrate the preferred coated abrasive articles, and the methods of making and using the same.

EXAMPLES

TEST PROCEDURE I (ENDLESS BELTS)

Coated abrasive materials converted to 203 cm by 6.3 cm continuous belts were installed on a Thompson Type C12 grinding machine. The effective cutting area of the abrasive belt was 2:54 cm by 203 cm. The workpiece abraded by these belts was 304 stainless steel, 2.54 cm width by 17.78 cm length by 10.2 cm height. Abrading was conducted along the 2.54 cm by 17.78 cm face. The workpiece was mounted on a reciprocating table. Speed of the abrasive belt was 1,707 meters per minute. The table speed, at which the workpiece traversed, was 6.1 meters per minute. The down-feed increment of the abrasive belt was 0.003 cm/pass of the workpiece. The process used was conventional surface grinding wherein the workpiece was reciprocated beneath the rotating abrasive belt with incremental downfeeding between each pass. This grinding was carried out dry. However, as the workpiece exited the grinding interface, on each pass it was flooded with water to cool it, followed by a blast of cool air. Each belt was used until it shelled. Shelling is the premature release of the abrasive particles; shelling typically reduces or ends the useful life of the coated abrasive.

TEST PROCEDURE II (FIBER DISCS)

A cured fiber disc having a diameter of 17.8 cm, with a 2.2 cm diameter center hole and a thickness of 0.76 mm was attached to an aluminum support pad and installed on a heavy flat test apparatus. The heavy flat test involved placing a workpiece in proximity to the outer periphery of the disc at the prescribed angle at the prescribed load for the prescribed time. The workpiece as a 304 stainless steel disc having a diameter of approximately 25.4 cm and a thickness of 0.18 cm. The test was conducted at a constant load (4 kg). The coated abrasive disc traversed at 3,500 rpm. The test endpoint was 20 minutes. The 304 stainless steel disc was weighed at 2 minute intervals during testing. The weight loss associated with the 304 stainless steel disc corresponded to the amount that the coated abrasive disc cut, i.e., the efficiency of the coated abrasive disc.

TEST PROCEDURE III (FIBER DISCS)

Fiber discs having a diameter of 17.8 cm, with a 2.2 cm diameter center hole and thickness of 0.76 mm were installed on a slide action testing machine. The fiber discs were first conventionally flexed to controllably break the hard bonding resins, mounted on a beveled aluminum back-up pad., and used to grind the face of 2.5 cm by 18 cm 304 stainless steel workpiece. The disc was driven at 5,500 rpm while the portion of the disc overlaying the beveled edge of the back-up pad contacted the workpiece at 5.91 kg pressure, generating a disc wear path of about 140 $cm^2$. Each disc was used to grind a separate workpiece for one minute each, for a total time of 12 minutes each.

TEST PROCEDURE IV

Fiber discs having a diameter of 17.8 cm, with a 2.2. cm diameter center hole and thickness of 0.76 mm were installed on a swing arm testing machine. The fiber discs were first conventionally flexed to controllably break the hard bonding resins, mounted on a beveled aluminum back-up pad, and used to grind the edge of a titanium disc workpiece. The disc was driven at 1710 rpm while the portion of the disc overlaying the beveled edge of the back-up pad contacted the workpiece at 4.0 kg pressure. Each disc was used to grind the same workpiece for a total of either eight or ten minutes and the workpiece was weighed after every one minute of grinding.

| Materials | |
|---|---|
| CLS: | An aqueous, 50 percent solids, fermented spent sulfite liquor consisting of calcium lignosulfonate having the trade designation "LIGNOSITE CX", commercially available from Georgia-Pacific Corporation, Bellingham, WA. |
| BPAW: | A composition containing a diglycidyl ether of bisphenol A epoxy resin coatable from water containing approximately 60 percent solids and 40 percent water. This composition, which had the trade designation "CMD 35201", was purchased from Rhone-Poulenc, Inc., Louisville, Kentucky. This composition also contained a nonionic emulsifier. The epoxy equivalent weight ranged from about 600 to about 700. |
| RPI: | A resole phenolic resin with 75 percent solids (non-volatile). |
| EMI: | 2-Ethyl-4-methyl imidazole. This curing agent, which had the designation "EMI-24", was commercially available from Air Products, Allentown, Pennsylvania. |
| $KBF_4$: | 98 percent pure micropulverized potassium tetrafluoroborate, in which 95 percent by weight passes through a 325 mesh screen and 100 percent by weight passes through a 200 mesh screen. (The screen used was a metallic mesh screen that was a USDA standard testing sieve available from W.S. Tyler, Inc., Mentor, OH.) |
| PVC: | Polyvinyl chloride which had the trade designation "GEON 103EPF-76", was commercially available from the Specialty Polymers & Chemicals Div. of B. F. Goodrich of Cleveland, Ohio. |
| IO: | Red iron oxide. |

-continued

| Materials | |
|---|---|
| HP: | A mixture of 85 percent 2-methoxy propanol and 15 percent $H_2O$, commercially available from Worum Chemical Co., St. Paul, MN. |
| AOT: | A dispersing agent (sodium dioctyl sulfosuccinate), which had the trade designation "Aerosol OT" was commercially available from Rohm and Haas Company, Philadelphia, PA. |
| F7TX: | Grade 320 (average particle size of 34.3 micrometers) white fused aluminum oxide abrasive grain. |
| MSCA: | Gamma-methacryloxypropyltrimethoxysilane, known under the trade designation "A-174," from Union Carbide, Danbury, CT. |
| CACO: | Calcium carbonate. |
| G-660: | A polyvinyl chloride latex, known under the trade designation "GEON 660-X14," from B. F. Goodrich, Cleveland, OH. |
| CRY: | Cryolite (trisodium hexafluoroaluminate). |
| ASP: | Amorphous silica particles having an average surface area of 50 $m^2/g$, and average particle size of 40 millimicometers, commercially available from Degussa Corp., Ridgefield Park, NJ under the trade designation "OX-50". |
| TATHEIC: | Triacrylate of tris(hydroxyethyl) isocyanurate, commercially available from Sartomer Company, Inc., Exton, PA. |
| TMPTA: | Trimethylol propane triacrylate, commercially available from Sartomer Company, Inc., Exton, PA. |
| PH1: | 2,2-dimethoxy-1-2-diphenyl-1-ethanone, commercially available from Ciba-Geigy Company, Hawthorne, NY, under the trade designation "IRGACURE 651". |
| DiNP: | Diisononyl phthalate plasticizer, commercially available from EXXON, Houston, TX. |
| CY-303: | A hexamethyolated, methanol blocked melamine resin commercially available from American Cyanamide, Wayne, NJ, under the trade designation "Cymel-303". |
| NACURE 155: | Dinonyl naphthalene disulfonic acid, 50% solids in alcohol, commercially available from King Industries Inc., Norwalk, CT. |
| OXY-0565: | A vinyl chloride/vinyl acetate copolymer commercially available from Occidental Chemical Corp, Dallas, TX, under the trade designation "OXY-0565". |

GENERAL PROCEDURE FOR MAKING COATED ABRASIVE (ENDLESS BELTS)

For the following examples made using this procedure, the backing of each coated abrasive consisted of a Y weight woven polyester cloth which had a four over one weave. Each backing was saturated with a s latex/phenolic resin and then placed in an oven to partially cure this resin. Next, a calcium carbonate-filled latex/phenolic resin pretreatment coating was applied to the back side of each backing. Each coated backing was heated to about 120° C. and maintained at this temperature until the resin had cured to a tack-free state. Finally, a pretreatment coating of latex/phenolic resin was applied to the front side of each coated backing and each coated backing was heated to about 120° C. and maintained at this temperature until the resin had precured to a tack-free state. Each backing made by this procedure was completely pretreated and was ready to receive a make coating.

A coatable mixture for producing a make coating for each coated backing was prepared by mixing 69 pads of 70 percent solids phenolic resin (48 parts phenolic resin), 52 pads non-agglomerated calcium carbonate filler (dry weight basis), and enough of a solution of 90 parts water/10 parts ethylene glycol monoethyl ether to form a make coating in each case which was 84 percent solids, with a wet coating weight of 155 $g/m^2$. The make coating was applied in each case via knife coating. This make coating was allowed to dry at ambient conditions overnight.

Next, grade 36 (ANSI standard B74.18 average particles size of 591 micrometers) ceramic aluminum oxide abrasive particles were drop coated onto the uncured make coatings with a weight of 827 $g/m^2$.

Then the resulting constructions received a precure of 15 minutes at 65° C., followed by 75 minutes at 88° C.

An 82 percent solids coatable mixture suitable for forming a size coating consisted of 32 percent RPI, 50.2 percent CRY, 1.5 percent IO, and 16.3 percent HP was then applied over the abrasive particles/make coating construction via two-roll coater. The wet size coating weight in each case was about 465 $g/m^2$. The resulting coated abrasives received a thermal cure of 30 minutes at 88° C. followed by 12 hours at 100° C.

After this thermal cure, the coated abrasives were single flexed (i.e., passed over a roller at an angle of 90° to allow a controlled cracking of the make and size coatings), then converted into 7.6 cm by 203 cm coated abrasive belts.

GENERAL PROCEDURE I FOR MAKING COATED ABRASIVES (DISCS)

A coated abrasive disc was prepared according to the following procedure. A 0.76 mm thick vulcanized fiber backing having a 2.2 cm diameter center hole was coated with Composition C consisting of a conventional calcium carbonate filled resole phenolic resin (83 percent by weight solids) to form a make coating. The wet coating weight was approximately 164 $g/m^2$. Grade 36 (average particle size of 591 micrometers) ceramic aluminum oxide abrasive grains were drop coated onto the make coat at a weight of approximately 740 $g/m^2$. The resulting abrasive article was precured for 150 minutes at 93° C. A size composition consisting of 32 percent RP1, 50.2 percent CRY, 1.5 percent IO, and 16.3 percent HP was applied over the abrasive grains and the make coating at an average weight of approximately 699

$g/m^2$ to form a size coat. The resulting product was cured for 11-½ hours at 93° C. After this step, the coated abrasive discs were flexed and humidified at 45 percent relative humidity for one week prior to testing.

GENERAL PROCEDURE II FOR MAKING COATED ABRASIVES (DISCS)

A coated abrasive disc was prepared according to the following procedure. A 0.76 mm thick vulcanized fiber backing having a 2.2 cm diameter center hole was coated with a conventional calcium carbonate filled resole phenolic resin (83% by weight solids) to form a make coat. The wet coating weight was approximately 161 $g/m^2$. Grade 50 (average particle size of 375 micrometers) silicon carbide abrasive grains were electrostatically coated onto the make coat at a weight of approximately 695 $g/m^2$. The resulting abrasive article was precured for 150 minutes at 93° C. A size composition consisting of 32% RP1, 51.7% $CaCO_3$ and 16.3% HP was applied over the abrasive grains and the make coat at an average weight of approximately 605 $g/m^2$ to form a size coat. The resulting product was cured from 1-½ hours at 93° C. After this step, the coated abrasive discs were flexed and humidified at 45% relative humidity for one week.

GENERAL PROCEDURE FOR MAKING STRUCTURED COATED ABRASIVE ARTICLES

The procedure was generally in accordance with assignee's U.S. Pat. No. 5,152,917 (Pieper et al.). First, a slurry was prepared by thoroughly mixing 22.3% by weight binder resin composition (70/30/1 of TMPTA/TATHEIC/PH1), 0.85% ASP, 1,1% MSCA, 58.7% grade P320 F7TX, and 17.1% $KBF_4$. The slurry used in each case was coated into a production tool with a random pitch pattern. The height of this pattern was 14 mil or 355 microns. This pattern was essentially the same pattern as described in the examples of USSN 08/120,300, incorporated herein by reference.

The production tool was a continuous web made from a polypropylene sheet material commercially available from Exxon, Houston, Tex, under the trade designation "PolyPro 3445". The production tool was embossed off of a nickel-plated master. The master tool was made by diamond cutting a pattern of varying dimension grooves and indentations directed, for example, according to computer programs and then nickel plating the master tool.

In general, the production tool, as made from the master tool, contained an array of cavities that were inverted five sided pyramids (inclusive of the mouth of the cavity as a "base") that had a constant depth of about 355 micrometers but varied in dimension between 8 and 45 degrees for adjacent cavities in terms of the angle made by side faces with the intersection of a plane extending normal to the plane of the tool and the material-included angle or apex angle of each composite was at least 25 degrees.

Next, a J weight rayon cloth was pressed against the production tool by means of a roller so that the slurry wetted the front surface of the cloth. This J weight rayon backing contained a dried phenolic/latex presize.

Ultraviolet light was then transmitted through the polypropylene tool and into a slurry. The ultraviolet light initiated the polymerization of the radiation curable resin contained in the slurry, resulting in the slurry being transformed into an abrasive composite, with the abrasive composite being adhered to the cloth backing. The ultraviolet light sources used were two bulbs known under the trade designation "Fusion Systems D bulbs" which operated at 600 watts/in (23,600 J/s•m) of bulb width. Finally, the cloth/abrasive composite was separated from the polypropylene production tool, providing a structured coated abrasive article.

PROCEDURE FOR PREPARING GRINDING AID AGGOLOMERATES 1800 grams (total) of $KBF_4$ powder, PVC, or a combination were blended with 200 grams of 50 percent solids (aq) calcium lignosulfonate (CLS). This mixture was placed into an oven at 100° C. for at least 4 hours. Crushing and screening the resulting hardened cake produced the desired agglomerate sizes.

EXAMPLES 1 TO 4 AND COMPARATIVE EXAMPLES A AND B

The coated abrasives for Examples 1 to 4 and Comparative Examples A and B were made according to the General Procedure for Making Coated Abrasives (Endless Belts) with the following coating weights:

| Materials | Coating Weight ($g/m^2$) |
|---|---|
| make coating (wet) | 194 |
| agglomerates (10% binder) | 77 |
| ceramic $Al_2O_3$ | 837 |
| size coating (wet) | 542 |

The agglomerates containing a variety of weight ratio combinations of $KBF_4$ and PVC were made by the Procedure for Preparing Grinding Aid Agglomerates. The agglomerates had an average particle size of about 700 micrometers. The agglomerates were drop coated into uncured make resin immediately after applying ceramic $Al_2O_3$. Test Procedure I was utilized to test these examples. The performance results are set forth in Table 1:

TABLE 1

| Example | % Weight Ratio $KBF_4$/PVC | Total Cut (grams) | Specific Energy (Es)* (Joules/$mm^3$) |
|---|---|---|---|
| Example 1 | 80/20 | 1312 | 7.1 |
| Example 2 | 60/40 | 1361 | 8.2 |
| Example 3 | 40/60 | 1059 | 8.5 |
| Example 4 | 20/80 | 825 | 7.1 |
| Comp. Ex. A | 100/0 | 1232 | 9.3 |
| Comp. Ex. B | 0/100 | 858 | 7.4 |

*Specific Energy is the amount of energy needed to remove a unit volume of material (J/$mm^3$) and is calculated by dividing the horsepower by the rate of cut. Horsepower can be obtained by multiplying the measured tangential grinding force by the belt speed.

Examples 1 to 4 containing a combination of $KBF_4$ and PVC in comparison to the Comparative Examples A and B containing 100% $KBF_4$ or 100% PVC, respectively. In this test, the 80/20 and 60/40 combinations of $KBF_4$ and PVC gave rise to superior total cut results in comparison to $KBF_4$ or PVC alone.

EXAMPLES 5 TO 8 AND COMPARATIVE C AND D

The coated abrasives for Examples 5 to 8 and Comparative Examples C and D were made according to the General Procedure I for Making Coated Abrasives (Discs) with these coating weights:

| Materials | Coating Weight (g/m$^2$) |
|---|---|
| make coating | 164 |
| ceramic $Al_2O_3$ | 740 |
| size coating | 699 |
| supersize coating (wet) | 411 |

A variety of weight ratio combinations including 80/20, 60/40, 40/60, 20/80 of $KBF_4$ and PVC, as representative of the present invention, were formulated into an aqueous supersize compositions consisting of 29.2 percent BPAW, 0.35 percent EMI, 53.3 percent total $KBF_4$/PVC, 14.1 percent water, 0.75 percent AOT, and 2.3 percent IO. This supersize was roll coated followed by curing at 115° C. for 90 minutes. Comparative Examples C and D had the above supersize composition with either 100% $KBF_4$ or 100% PVC. Test Procedure II was utilized to test these examples. The performance results are set forth in Table 2.

TABLE 2

| Example | % Weight Ratio $KBF_4$/PVC | Total Cut (grams) |
|---|---|---|
| Example 5 | 80/20 | 197 |
| Example 6 | 60/40 | 204 |
| Example 7 | 40/60 | 185 |
| Example 8 | 20/80 | 196 |
| Comp. Ex. C | 100/0 | 171 |
| Comp. Ex. D | 0/100 | 169 |

In this test, the combination of $KBF_4$/PVC gave rise to superior total cut results in comparison to $KBF_4$ or PVC alone.

EXAMPLES 9 TO 12 AND COMPARATIVE EXAMPLES E, F, and G

The coated abrasives for Examples 9 to 12 and Comparative Examples F and G were made according to the General Procedure for Making Coated Abrasives (Endless Belts) with these coating weights:

| Materials | Coating Weight (g/m$^2$) |
|---|---|
| make coating (wet) | 194 |
| ceramic $Al_2O_3$ | 837 |
| size coating | 542 |
| supersize coating | 411 |

A variety of weight ratio combinations of $KBF_4$ and PVC were formulated into aqueous supersize, roll coated, and cured. Test Procedure I was utilized to test these examples. The performance results are set forth in Table 3.

Comparative Example E was made according to the General Procedure for Making Coated Abrasives (Endless Belts), but was not supersized (no $KBF_4$ nor PVC). Coating weights (make, mineral, and size) were the same as for Examples 9 to 12.

TABLE 3

| Example | % Weight Ratio $KBF_4$/PVC | Total Cut (grams) | Specific Energy (Es) (Joules/mm$^3$) |
|---|---|---|---|
| Example 9 | 80/20 | 2491 | 11.2 |
| Example 10 | 60/40 | 2534 | 9.3 |
| Example 11 | 40/60 | 2794 | 9.6 |

TABLE 3-continued

| Example | % Weight Ratio $KBF_4$/PVC | Total Cut (grams) | Specific Energy (Es) (Joules/mm$^3$) |
|---|---|---|---|
| example 12 | 20/80 | 2862 | 7.6 |
| Comp. Ex. E | 0/0 | 1976 | 7.9 |
| Comp. Ex. F | 100/0 | 2504 | 9.3 |
| Comp. Ex. G | 0/100 | 2908 | 10.9 |

No improvement in performance is noted in this test but, as noted, the combination of grinding aids, i.e., $KBF_4$ and PVC, gave rise to an improvement over either grinding aid alone in other applications shown by the data, for example, in Tables 2, 4, 5, 6, 7, 8, 9, 10, and 11.

EXAMPLE 13 AND COMPARATIVE EXAMPLES H and I

The coated abrasives for Example 13 and for Comparative Examples H and I were made according to the General Procedure I for Making Coated Abrasives (Discs) with these coating weights:

| Materials | Coating Weight (g/m$^2$) |
|---|---|
| make coating | 164 |
| agglomerates (10% binder) | 74 |
| ceramic $Al_2O_3$ | 740 |
| size coating (wet) | 699 |

Agglomerates. The agglomerates had an average particle size of about 700 micrometers. The agglomerates were drop coated into uncured make resin immediately after applying ceramic $Al_2O_3$. Test procedure II was utilized to test these examples. The performance results are set forth in Table 4:

TABLE 4

| Example | Grinding Aid in Agglomerate | Total Cut (grams) |
|---|---|---|
| Example 13 | $KBF_4$/PVC (1:1) | 163 |
| Comp. Ex. H | PVC | 127 |
| Comp. Ex. I | $KBF_4$ | 131 |

This data shows that combining $KBF_4$ and PVC results in superior total cut performance in comparison to either grinding aid alone.

EXAMPLE 14 AND COMPARATIVE EXAMPLES J AND K

The coated abrasives for Example 14 and Comparative Examples J and K were made according to the General Procedure I for Making Coated Abrasives (Discs) with these coating weights:

| Materials | Coating Weight (g/m$^2$) |
|---|---|
| make coating (wet) | 164 |
| ceramic $Al_2O_3$ | 740 |
| size coating (wet) | 699 |
| supersize coating | 411 |

Supersizes containing $KBF_4$ alone and separately 1:1 $KBF_4$:PVC were formulated in aqueous epoxy supersize followed by roll coating and curing as described in the experimental section for Examples 5 to 8. Test Procedure II was used to evaluate these examples. Comparative Example J was made in the same way, but no supersize was applied. The performance results are set forth in Table 5.

TABLE 5

| Example | Grinding Aid in Supersize | Total Cut (grams) |
|---|---|---|
| Example 14 | $KBF_4$/PVC (1:1) | 294 |
| Comp. Ex. J | None | 157 |
| Comp. Ex. K | $KBF_4$ | 243 |

In this test, superior total cut performance results from the combination of $KBF_4$ and PVC in a supersize system as opposed to systems containing either grinding aid alone.

EXAMPLE 15 and COMPARATIVE EXAMPLE L

The coated abrasives for Examples 15 and Comparative Example L were made according to the General Procedure I for Making Coated Abrasive (Discs) with the coating weights as indicated in the table below:

| Example | Make Resin ($g/m^2$) | Ceramic $Al_2O_3$ ($g/m^2$) | Grinding Aid Agglomerates ($g/m^2$) | Size Resin ($g/m^2$) |
|---|---|---|---|---|
| Example 15 | 123 | 370 | 82 | 576 |
| Comp. Ex. L | 123 | 740 | 0.0 | 576 |

Agglomerates comprised of 60 percent $KBF_4$ and 40 percent PVC were made by the Procedure for Preparing Grinding Aid Agglomerates. The agglomerates had an average particle size of about 700 micrometers. The agglomerates were drop coated into uncured make resin immediately after applying ceramic $Al_2O_3$. Test Procedure III was utilized to test these examples. The performance results are set forth in Table 6.

TABLE 6

| Example | Grinding Aid in Agglomerate | Total Cut (grams) |
|---|---|---|
| Example 15 | 60/40 $KBF_4$/PVC | 261 |
| Comp. Ex. L | None | 148 |

Example 15 contains 50% by weight of ceramic $Al_2O_3$ as compared with Comp. Ex. L. Example 15 contains 60/40 $KBF_4$/PVC agglomerates in the make resin while Comp. Ex. L does not have any added grinding aid in its structure. In conclusion, although Comp. Ex. L has twice the weight of ceramic aluminum oxide as compared to Example 15, the performance of Example 15 is 76% higher than Comp. Ex. L. The grinding aid combination is highly effective even when the mineral concentration is dramatically decreased.

EXAMPLE 16 AND COMPARATIVE EXAMPLES M AND N

Grade 100 XF 977F Regalloy belts, commercially available from 3 M Company of St. Paul, Minn, were obtained. Example 16 was supersized with an aqueous supersize having a 50:50 mixture by weight of $KBF_4$:G-660 (900 $g/m^2$). Comparative Example M had G-660 supersize (900 $g/m^2$). Comparative Example N was supersized with an aqueous supersize composition (900 $g/m^2$) that consisted of 29.2% BPAW, 0.35% EMI, 53.3% $KBF_4$, 14.1% Water, 0.75% AOT, and 2.3% IO.

After drying and curing at 100° C. for 90 minutes, flexing, and subjecting the belts to 35% relative humidity for 24 hours, the belts were tested on 304 stainless steel under constant rate conditions on the Thompson Grinder (Test Procedure 1 ). Thompson conditions included: 5,600 fpm (28 m/s), 20 fpm (3.9 mm/s) throughfeed, and downfeed of 2 mils or a rate of 0.48 $in^3$/min (5.16 $mm^3$/mm•s). Table 7 sets forth grinding data for these supersized belts.

TABLE 7

SUPERSIZES
GRADE 100 XF 977F REGALLOY/TEST PROCEDURE I

| Example | Total Cut (grams) |
|---|---|
| Example 16 | 1,280 |
| Comp. Ex. M | 1,054 |
| Comp. Ex. N | 1,171 |

Example 16 supersized with a combination of grinding aids having $KBF_4$ in PVC as a binder, performs better than a supersize containing only $KBF_4$ (Comparative N) or only a PVC coating (Comparative Example M).

EXAMPLE 17 AND EXAMPLE O

The slurry composition for Comparative Example O is as described in the General Procedure for Making Structured Coated Abrasive Articles. Example 17 was made by the same procedural method as Comparative Example O except that a slurry as follows was used: 32.7% parts by weight binder resin composition (70:30:1 of TMPTA/TATHEIC/PH1 ),0.8% ASP, 0.8% MSCA, 50.2% F7TX, 7.7% $KBF_4$, and 7.7% PVC. Both of these structured coated abrasive articles were made by the General Procedure for Making Structured Abrasive Articles.

After drying or curing at 100° C. for 90 minutes, flexing, and subjecting the belts to 35% relative humidity for 24 hours, the belts were tested on 304 stainless steel under constant rate conditions on the Thompson Grinder (Test Procedure I). Thompson conditions included: 5,600 fpm (28 m/s), 20 fpm (3.9 mm/s) throughfeed, and downfeeds of 0.25, 0.5 and 0.75 mils (6.4, 12.7, and 19.7 μm, respectively) or rates of 0.05, 0.10, and 0.15 $in^3$/min (0.5, 1.1, and 1.6 $mm^3$/mm•s, respectively). Table 8 sets forth grinding data for these structured abrasive belts. Comparative Example O contains more mineral (58.7% versus 50.2%) than Example 17 and more grinding aid (17.1 versus 15.4%) than Example 17.

TABLE 8

| Example | Cut Rate ($cc^3$/min) | Total Cut (grams) | % of Comp. Ex. K |
|---|---|---|---|
| Example 17 | 0.82 | 184.6 | 123 |
| Comp. Ex. O | 0.82 | 150.1 | 100 |
| Example 17 | 1.64 | 120.9 | 129 |
| Comp. Ex. O | 1.64 | 93.8 | 100 |
| Example 17 | 2.46 | 87.0 | 120 |
| Comp. Ex. O | 2.46 | 72.2 | 100 |

At each rate of cut, Example 17, containing the combination of $KBF_4$ and PVC, provides a much longer life than Comparative Example O, even though there is less mineral and grinding aid in Example 17 than in Comparative Example O.

EXAMPLE 18 AND COMPARATIVE EXAMPLES P AND Q

The procedure for preparing a slurry composition for Comparative Example Q is as described in the General Procedure for Making Structured Coated Abrasive Articles. A slurry for Comparative Example Q is as follows: 36.3% by weight binder resin composition (70:30:1 of TMPTA/TATHEIC/PH1), 0.75% ASP, 0.75% MSCA, 47.6% F7TX, and 14.6% $KBF_4$. Example 18 was made by the same procedural method as Comparative Example Q except that a slurry as follows was used: 36.3% by weight binder resin composition (70:30:1 of TMPTA/TATHEIC/PH1), 0.75% ASP, 0.75% MSCA, 47.6% F7TX, 7.3% $KBF_4$, and $_{7.3}$% PVC. Comparative Example P was made by the same procedural method as Comparative Example Q except that a slurry as follows was used: 36.3% by weight binder resin composition (70:30:1 of TMPTA/TATHEIC/PH1), 0.75% ASP, 0.75% MSCA, 47.6% F7TX, and 14.6% PVC. These structured coated abrasive articles were made by the General Procedure for Making Structured Abrasive Articles.

After drying or curing at 100° C. for 90 minutes, flexing, and subjecting the belts to 35% relative humidity for 24 hours, the belts were tested on 304 stainless steel under constant rate conditions on the Thompson Grinder (Test Procedure I). Thompson conditions included: 5,600 fpm (28 m/s), 20 fpm (3.9 mm/s) throughfeed, and downfeeds of 0.25, 0.5 and 0.75 mils (6.4, 12.7, and 19.7 μm, respectively) or rates of 0.06, 0.12, and 0.18 $in^3$/min (0.65, 1.29, and 1.94 $mm^3$/mm•s, respectively). Table 9 displays grinding data for these structured abrasive belts. Comparative Examples P and Q and Example 18 contain equal percent of mineral (47.6%) and equal weight percent of total grinding aid (14.6%).

TABLE 9

| Example | Cut Rate ($cc^3$/min) | Total Cut (grams) | % of Comp. Ex. Q |
|---|---|---|---|
| Example 18 | 0.98 | 183 | 123 |
| Comp. Ex. P | 0.98 | 68 | 43 |
| Comp. Ex. Q | 0.98 | 150 | 100 |
| Example 18 | 1.96 | 121 | 129 |
| Comp. Ex. P | 1.96 | 56 | 61 |
| Comp. Ex. Q | 1.96 | 94 | 100 |
| Example 18 | 1.96 | 86 | 121 |
| Comp. Ex. P | 1.96 | 35 | 49 |
| Comp. Ex. Q | 1.96 | 72 | 100 |

Example 18 containing a combination of grinding aids showed a cut performance improvement over examples containing either PVC alone (Comp. Ex. P) or $KBF_4$ alone (Comp. Ex. Q).

EXAMPLE 19 AND COMPARATIVE EXAMPLES R AND S

The discs used were 3M 981C Regal Resin Bond grade 40 fibre discs manufactured by Minnesota Mining and Manufacturing Co., St. Paul, Minn. Comparative Example S had no supersize. Comparative Example R had a cured aqueous epoxy supersize formulation consisting of 29.2% BPAW, 0.35% EMI, 53.3% $KBF_4$, 14.1% water, 0.75% AOT, and 2.3% IO. Example 19 had a supersize formulation prepared by placing 210 parts plasticizer into a Hobart or Kitchen Aid "bread dough mixer" and then adding 280 parts OXY 0565 (a PVC copolymer from Occidental) with stirring. After 20 to 30 minutes of stirring, the following formulation was prepared in the same mixer with the plasticizer and PVC: 30% OXY 050; 22.5% DiNP; 22.5% $KBF_4$; 23% CY-303; and 2% NACURE 155. The plastisol supersize formulations were brushed over the cured size on the 3M 981C Regal Resin Bond grade 40 fibre discs.

Test Procedure III was employed to evaluate these discs and the results are set forth in Table 10. Superior results were obtained by discs having a supersize containing the $KBF_4$/PVC combination, particularly in the formulation that contained the thermosetting resin "CYMEL 303" (Example 19).

TABLE 10

GRADE 40 $Al_2O_3$/SLIDE ACTION TEST ON STAINLESS STEEL

| Example | Wt. of Supersize | 1st. Min. Cut (grams) | 8th Min. Cut (grams) | Total Cut (grams) | % of Comp. Ex. M |
|---|---|---|---|---|---|
| Ex. 19 | 5.3 | 30.9 | 3.1 | 135.2 | 195 |
| Comp. Ex. R | 2.3 | 28.0 | 3.6 | 77.3 | 112 |
| Comp. Ex. S | — | 14.4 | 5.5 | 69.2 | 100 |

EXAMPLES 20 AND COMPARATIVE EXAMPLES T AND U

Example 20 and Comparative Examples T and U were Grade 50 SiC fibre discs made according to the General Procedure II for Making Coated Abrasives Discs. Comparative Example T had an aqueous supersize identical to Comparative Example S. The temperature used to cure this supersize was 100° C. Example 20 had a supersize formulation prepared by placing 210 parts of DiNP-Exxon plasticizer into a Hobart or Kitchen aid "bread dough mixer" and then adding 280 parts OXY 0565 (a PVC copolymer from Occidental) with stirring. After 20 to 30 minutes of stirring, the following formulation was prepared in the same mixer with the plasticizer and PVC: 30% OXY 0565, 22.5% DiNP, 22.5% $KBF_4$, 23% CY-303, and 2% NACURE 155. This plastisol formulation was brushed over cured size on the discs. Fusion or cure of the supersize was performed in the oven for 10 to 15 minutes at approximately 150° C. Comparative Example U did not contain a supersize.

Test procedure IV was utilized and the test results are set forth in Table 11.

TABLE 11

GRADE 50 SiC/SWING ARM TEST ON TITANIUM

| Example | Wt. of supersize (grams) | 1st. Min. Cut (grams) | 8th Min. Cut (grams) | Total Cut (grams) | % of Comp. Ex. N |
|---|---|---|---|---|---|
| Ex. 20 | 5.8 | 1.65 | 1.3 | 11.1 | 159 |
| Comp. Ex. T | 4.0 | 1.7 | 0.8 | 8.3 | 118 |
| Comp. Ex. U | — | 1.6 | 0.5 | 7.0 | 100 |

In this test, the discs having a supersize containing a combination of grinding aids in a plastisol formulation containing a thermosetting resin, e.g. CYMEL 303, produced superior performance to both a supersize containing only $KBF_4$ (Comparative Example T) and an unsupersized disc (Comparative Example U). In fact, the disc having a thermosetting resin in the plastisol supersize, i.e., Example 20, performed very well at or during the eighth minute of grinding.

What is claimed is:

1. An abrasive article comprising a plurality of abrasive particles, a binder to which said plurality of abrasive particles are adhered, and a combination of potassium tetrafluoroborate and a halogenated polymer.

2. The abrasive article of claim 1 wherein said combination of said potassium tetrafluoroborate and said halogenated polymer are incorporated into said binder.

3. The abrasive article of claim 2 wherein said combination of said potassium tetrafluoroborate and said halogenated polymer is incorporated into a plurality of erodible grinding aid agglomerates, said agglomerates being incorporated into said binder.

4. The abrasive article of claim 1 wherein said abrasive article comprises a peripheral coating comprising said combination of said potassium tetrafluoroborate and said halogenated polymer.

5. The abrasive article of claim 4 wherein said combination of said potassium tetrafluoroborate and said halogenated polymer is incorporated into a plurality of erodible grinding aid agglomerates, said agglomerates being adhered in or to said peripheral coating.

6. The abrasive article of claim 4 wherein said peripheral coating comprises potassium tetrafluoroborate and a polyvinylchloride binder.

7. The abrasive article of claim 4 wherein said peripheral coating comprises potassium tetrafluoroborate in a binder comprising a blend of a plasticized halogenated polymer and a thermosetting resin.

8. The abrasive article of claim 7 wherein said halogenated polymer is polyvinylchloride.

9. The abrasive article of claim 1 wherein said halogenated polymer is selected from the group consisting of polyvinylidene chloride and polyvinyl chloride.

10. The abrasive article of claim 1 wherein said potassium tetrafluoroborate and said halogenated polymer are present in a weight ratio of potassium tetrafluoroborate to halogenated polymer of between 10:90 and 90:10.

11. The abrasive article of claim 1 wherein said potassium tetrafluoroborate and said halogenated polymer are present in a weight ratio of potassium tetrafluoroborate to halogenated polymer of between 30:70 and 70:30.

12. An erodible grinding aid agglomerate comprising a plurality of potassium tetrafluoroborate particles, a halogenated polymer, and a binder that adheres said potassium tetrafluoroborate particles and said halogenated polymer together.

13. The erodible grinding aid agglomerate of claim 12 wherein said halogenated polymer is selected from the group consisting of polyvinyl chloride and polyvinylidene chloride.

14. A structured abrasive article comprising a backing having a major surface, a plurality of abrasive composites, each abrasive composite comprising a plurality of abrasive particles, a binder, and a combination of potassium tetrafluoroborate and a halogenated polymer.

15. The structured abrasive article of claim 14 wherein said combination of said potassium tetrafluoroborate and said halogenated polymer are incorporated in a plurality of erodible grinding said agglomerates, said agglomerates being incorporated into said plurality of abrasive composites.

16. An abrasive article comprising:

(a) a plurality of abrasive particles;

(b) a binder adhering the abrasive particles therein; and (c) a grinding composition consisting of a mixture of potassium tetrafluoroborate and a halogenated polymer, said potassium tetrafluoroborate and said halogenated polymer are present in an amount which provides improved abrasive performance of said abrasive article in at least one abrasive application over abrasive performance of an abrasive article of the same type with a grinding composition consisting only of potassium tetrafluoroborate or halogenated polymer alone.

17. A coated abrasive article comprising:

(a) a backing having a major surface;

(b) a plurality of abrasive particles;

(c) a binder which bonds said abrasive particles to said backing, and (d) a plurality of potassium tetrafluoroborate particles and a halogenated polymer.

18. The coated abrasive article of claim 17 wherein said potassium tetrafluoroborate particles and said halogenated polymer are bonded by said binder to said major surface of said backing.

19. The coated abrasive article of claim 18 wherein said potassium tetrafluoroborate particles and said halogenated polymer are incorporated in a plurality of erodible agglomerates.

20. The coated abrasive article of claim 17 further comprising a peripheral coating.

21. The coated abrasive article of claim 20 wherein said potassium tetrafluoroborate particles and said halogenated polymer are present in the peripheral coating.

22. The coated abrasive article of claim 21 wherein said potassium tetrafluoroborate particles and said halogenated polymer are incorporated in a plurality of erodible agglomerates.

23. The coated abrasive article of claim 17 wherein said halogenated polymer is selected from the group consisting of polyvinyl chloride and polyvinylidene chloride.

24. The coated abrasive article of claim 17 wherein said potassium tetrafluoroborate particles and said halogenated polymer are present in a weight ratio of between 10:90 and 90:10.

25. The coated abrasive article of claim 17 wherein said potassium tetrafluoroborate particles and said halogenated polymer are present in a weight ratio of between 30:70 and 70:30.

* * * * *

UNITED STATES PATENT AND TRADEMARK OFFICE

CERTIFICATE OF CORRECTION

PATENT NO.: 5,562,745

DATED: October 8, 1996

INVENTOR(S): John J. Gagliardi, Jason A. Chesley, Charles H. Houck, Walter L. Harmer and Gary L. Olson It is certified that error appears in the above-identified patent and that said Letters Patent is hereby corrected as shown below:

Column 17, line 22, "1-1/2" should read --11-1/2--.

Signed and Sealed this

Eighteenth Day of August, 1998

Bruce Lehman

*Attest:*

BRUCE LEHMAN

*Attesting Officer*

*Commissioner of Patents and Trademarks*